US010759590B1

(12) United States Patent
Harris

(10) Patent No.: US 10,759,590 B1
(45) Date of Patent: Sep. 1, 2020

(54) PORTABLE PASTE DISPENSER

(71) Applicant: Hillel Harris, Jerusalem (IL)

(72) Inventor: Hillel Harris, Jerusalem (IL)

( * ) Notice: Subject to any disclaimer, the term of this patent is extended or adjusted under 35 U.S.C. 154(b) by 0 days.

(21) Appl. No.: 16/669,550

(22) Filed: Oct. 31, 2019

(30) Foreign Application Priority Data

Jun. 27, 2019 (IL) ..... 267706

(51) Int. Cl.
*B65D 83/00* (2006.01)
*B65D 85/72* (2006.01)
*B65D 35/30* (2006.01)

(52) U.S. Cl.
CPC ..... *B65D 83/0022* (2013.01); *B65D 35/30* (2013.01); *B65D 85/72* (2013.01)

(58) Field of Classification Search
CPC ..... B65D 83/0022; B65D 35/30; B65D 85/72
USPC ..... 222/386, 392
See application file for complete search history.

(56) References Cited

U.S. PATENT DOCUMENTS 820,592 A * 5/1906 McLinden ..... B65D 83/0005 222/386
858,167 A * 6/1907 Erd ..... B65D 83/0005 222/386
2,166,619 A * 7/1939 Becker ..... B65D 83/0005 222/386
2,649,995 A * 8/1953 Muskin ..... B65D 83/0094 222/92
2,661,126 A * 12/1953 Spencer ..... B65D 83/0005 222/386
3,273,760 A * 9/1966 Frankenberg ..... B65D 83/0005 222/386
3,417,862 A * 12/1968 Fong ..... A23G 9/503 206/517
3,478,937 A * 11/1969 Solowey ..... A61M 5/5013 222/386
4,213,545 A * 7/1980 Thompson ..... B67D 1/0462 138/30
4,323,177 A * 4/1982 Nielsen ..... B65D 83/0005 222/386
5,016,784 A * 5/1991 Batson ..... B05C 17/00516 206/384
5,139,178 A * 8/1992 Arch ..... B05C 17/00516 222/326
5,680,967 A * 10/1997 Dang ..... B65D 83/0005 222/327
5,718,357 A * 2/1998 Dang ..... B05C 17/00576 222/153.06

(Continued)

*Primary Examiner* — Patrick M. Buechner
*Assistant Examiner* — Michael J. Melaragno
(74) *Attorney, Agent, or Firm* — Alphapatent Associates, Ltd; Daniel J. Swirsky

(57) ABSTRACT

In one aspect, the invention is directed to a portable paste dispenser having a container for storing paste, the container having a cylindrical part and a conical part, a nozzle at the end of the conical part, a piston, disposed inside the cylindrical part of the container, and a shaft connected to the piston, the shaft having a limited foldability so that when the shaft is pushed towards the piston, it still is able to move the piston along the cylindrical part, where the piston includes foldable bellows walls, thereby upon applying force on the piston, the piston straightens up, resulting in a conical form correspondingly to the conical part, thereby allowing fully emptying the container.

9 Claims, 9 Drawing Sheets

(56) References Cited

U.S. PATENT DOCUMENTS 6,231,904 B1 * 5/2001 Mueller ..... A23G 9/503 101/333
6,261,611 B1 * 7/2001 Berman ..... B65D 81/343 426/107
7,007,829 B1 * 3/2006 Mueller ..... B65D 51/28 222/129
8,235,257 B2 * 8/2012 Avairis ..... B65D 83/0011 222/342
8,505,785 B2 * 8/2013 Helmenstein ..... B05C 17/00576 222/326
8,668,119 B2 * 3/2014 Wheeler ..... B65D 35/44 220/707
8,899,451 B2 * 12/2014 Veltrop ..... B65D 83/0033 222/390
9,597,706 B2 * 3/2017 Burns ..... B05C 17/00576
2002/0148854 A1 * 10/2002 Egerhazy ..... B65D 35/30 222/107
2004/0134929 A1 * 7/2004 Scheindel ..... B65D 83/64 222/1
2007/0062977 A1 * 3/2007 Ferrarin ..... B65D 35/30 222/386
2007/0245893 A1 * 10/2007 Chen ..... A23P 30/20 92/247
2009/0065527 A1 * 3/2009 Buck ..... B05C 17/00576 222/95
2009/0224006 A1 * 9/2009 Post ..... F16H 19/04 222/333
2010/0196556 A1 * 8/2010 Wheeler ..... B65D 83/0005 426/115
2011/0101035 A1 * 5/2011 Beebe ..... A61M 5/31513 222/386
2011/0168737 A1 * 7/2011 Veltrop ..... F16G 13/20 222/41
2011/0168741 A1 * 7/2011 Veltrop ..... B05C 17/0113 222/392
2011/0168742 A1 * 7/2011 Veltrop ..... B05C 17/0113 222/392
2013/0026193 A1 * 1/2013 Sirkis ..... B01L 3/0217 222/386
2014/0054327 A1 * 2/2014 Veltrop ..... F16H 19/006 222/392
2014/0131394 A1 * 5/2014 Wheeler ..... B65D 35/44 222/386
2015/0053724 A1 * 2/2015 Veltrop ..... B65D 83/0033 222/392

* cited by examiner

STEP 3

FOLDED STATE

PORTABLE PASTE DISPENSER

TECHNICAL FIELD

The invention relates to the field of portable paste dispensers.

BACKGROUND

Presently portable sauce dispensers, such as ketchup, mayonnaise and mustard dispensers, are well known. Usually they are in the form of a flexible container in which a nozzle is disposed at the top thereof. In order to dispense the container's substance, a user turns the dispenser upside-down, and squeezes the flexible container.

One of the known problems of this type of dispensers is that some of their content cannot be dispensed, and actually it remains in the container.

The same problem applies also to toothbrush dispensers, jelly soap dispensers, and so on.

As such, there is a long felt need for a portable paste dispenser which is able to dispense its entire contents.

SUMMARY

In one aspect, the invention is directed to a portable paste dispenser (100), comprising:

a container (10), for storing therein paste (30), the container comprising a cylindrical part (11) and a conical part (13);

a nozzle (18) at the end of the conical part (13);

a piston (20), disposed inside the cylindrical part (11) of the container; and a shaft (26) connected to the piston, the shaft having a limited foldability so that when the shaft is pushed towards the piston, it still is able to move the piston along the cylindrical part (11);

wherein the piston comprises foldable bellows walls, thereby upon applying force on the piston, the piston straightens up, resulting in a conical form correspondingly to the conical part (13), thereby allowing fully emptying the container.

The dispenser may further comprise a pedestal (12) connected to the container from outside, for allowing detachably attaching the shaft (26) to the pedestal.

According to one embodiment of the invention, the shaft (26) comprises a plurality of mating links (27), each having a limited tilting ability with reference to its subsequent link.

According to one embodiment of the invention, the container (10) is rigid.

According to another embodiment of the invention, the container (10) is flexible, thereby allowing dispensing the paste also by squeezing the container (10), and emptying the container by pressing the piston towards the nozzle (18) musing the shaft (26).

The paste (30) may be ketchup, mayonnaise, toothpaste, shoe polish, etc.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Other aspects of the invention will become apparent as the description proceeds.

BRIEF DESCRIPTION OF THE DRAWINGS

Embodiments, features, and aspects of the invention are described herein in conjunction with the following drawings.

It should be understood that the drawings are not necessarily drawn to scale.

DETAILED DESCRIPTION

The invention will be understood from the following detailed description of embodiments which are meant to be descriptive and not limiting. For the sake of brevity, some well-known features, methods, systems, procedures, components, circuits, and so on, are not described in detail.

In the figures herein, the dispenser 100 and its parts are turned upside-down.

Figure 1:
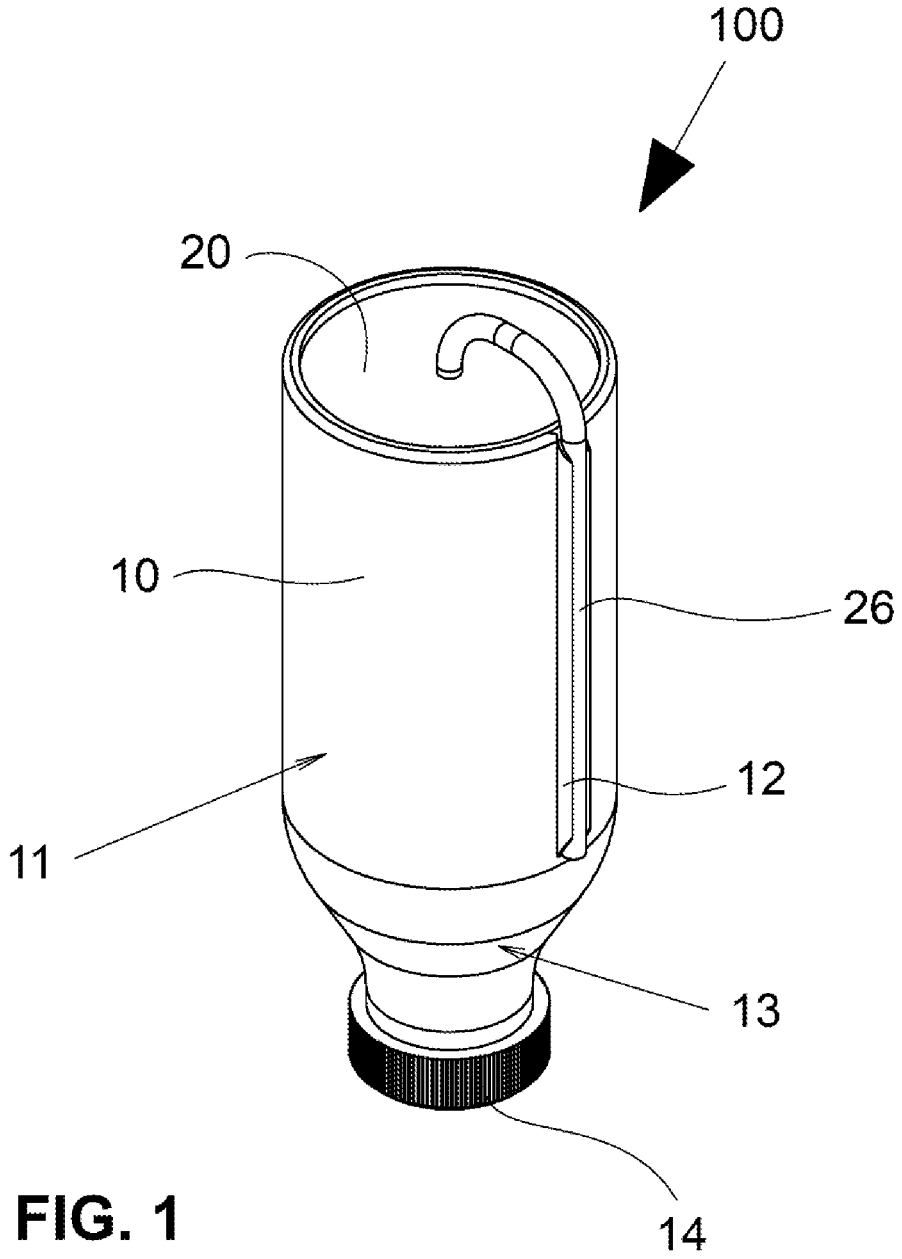
FIG. 1 is a perspective view of a portable paste dispenser, according to one embodiment of the invention.

FIG. 1 is a perspective view of a portable paste dispenser, according to one embodiment of the invention.

The portable paste dispenser, which is marked herein by reference numeral 100, comprises a container 10 having a cylindrical part 11, and a conical part 13; a piston 20 disposed in the inner side of the cylindrical part 11 of the container 10; and a foldable shaft 26 connected to the piston 20. The shaft may be detachably attached to a pedestal 12 which is connected to the container 10 from its outer side. Reference numeral 14 denotes a lid of the container 10.

As will be detailed hereinafter, the piston 20 is foldable such that in its unfolded state it turns to a conic form, correspondingly to the inner side of the conical part 13 of the container 10.

Figure 2:
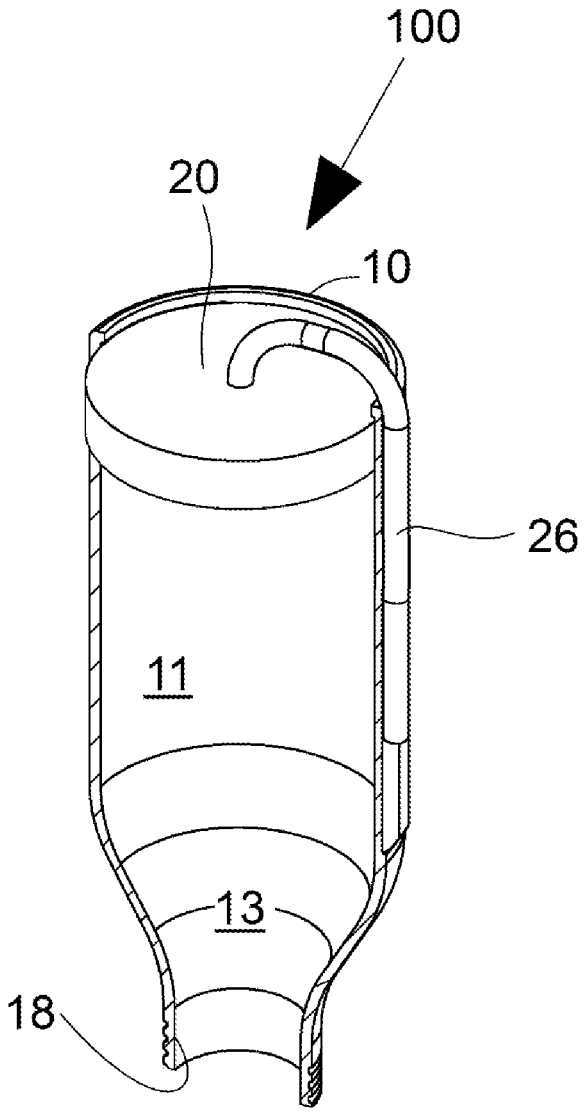
FIG. 2 is a sectioned-perspective view of a portable paste dispenser, according to one embodiment of the invention.

FIG. 2 is a sectioned-perspective view of a portable paste dispenser, according to one embodiment of the invention.

The illustrated dispenser contains no content, i.e., is empty.

Figure 3:
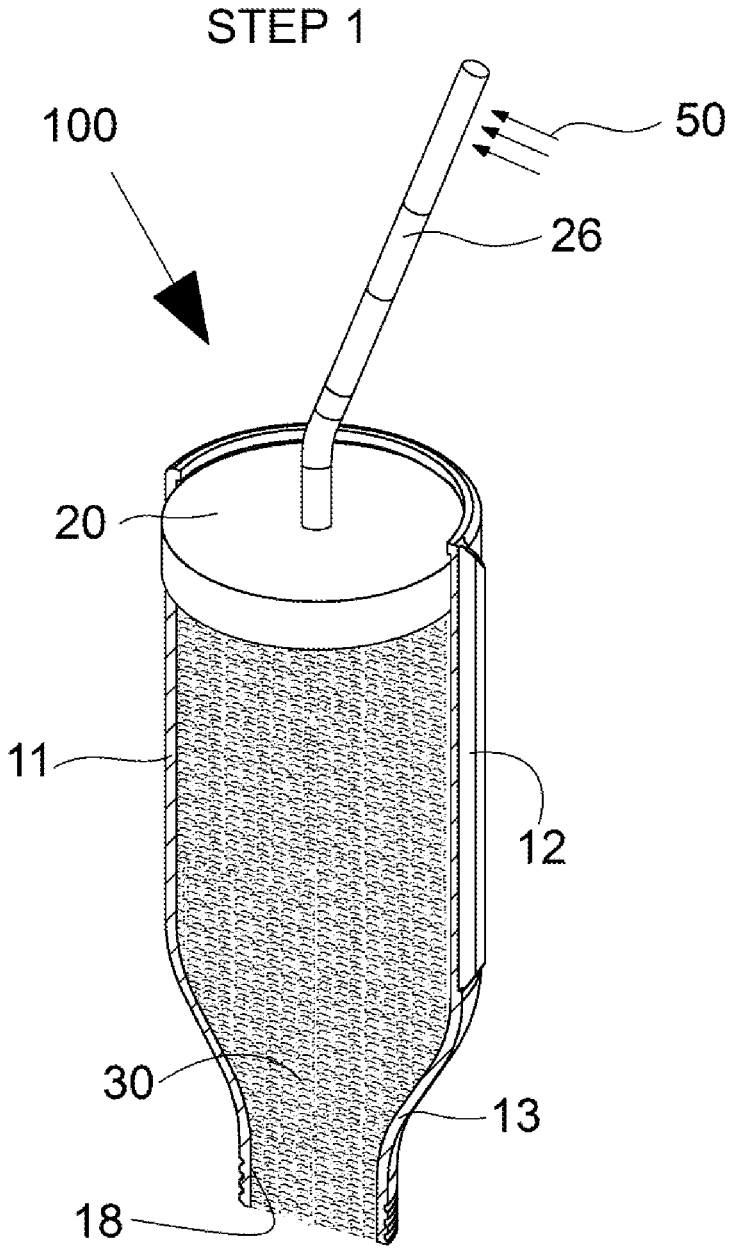
FIG. 3 is a sectioned-perspective view of a portable paste dispenser illustrating the first step of using thereof, according to one embodiment of the invention.

FIG. 3 is a sectioned-perspective view of a portable paste dispenser illustrating the first step of using thereof, according to one embodiment of the invention.

The illustrated dispenser contains paste 30, such as ketchup, mayonnaise, toothpaste, etc.

In order to dispense the content of container 10, a user firstly pulls (see arrows 50) the shaft 26 from its pedestal 12, and straightens it up.

Figure 4:
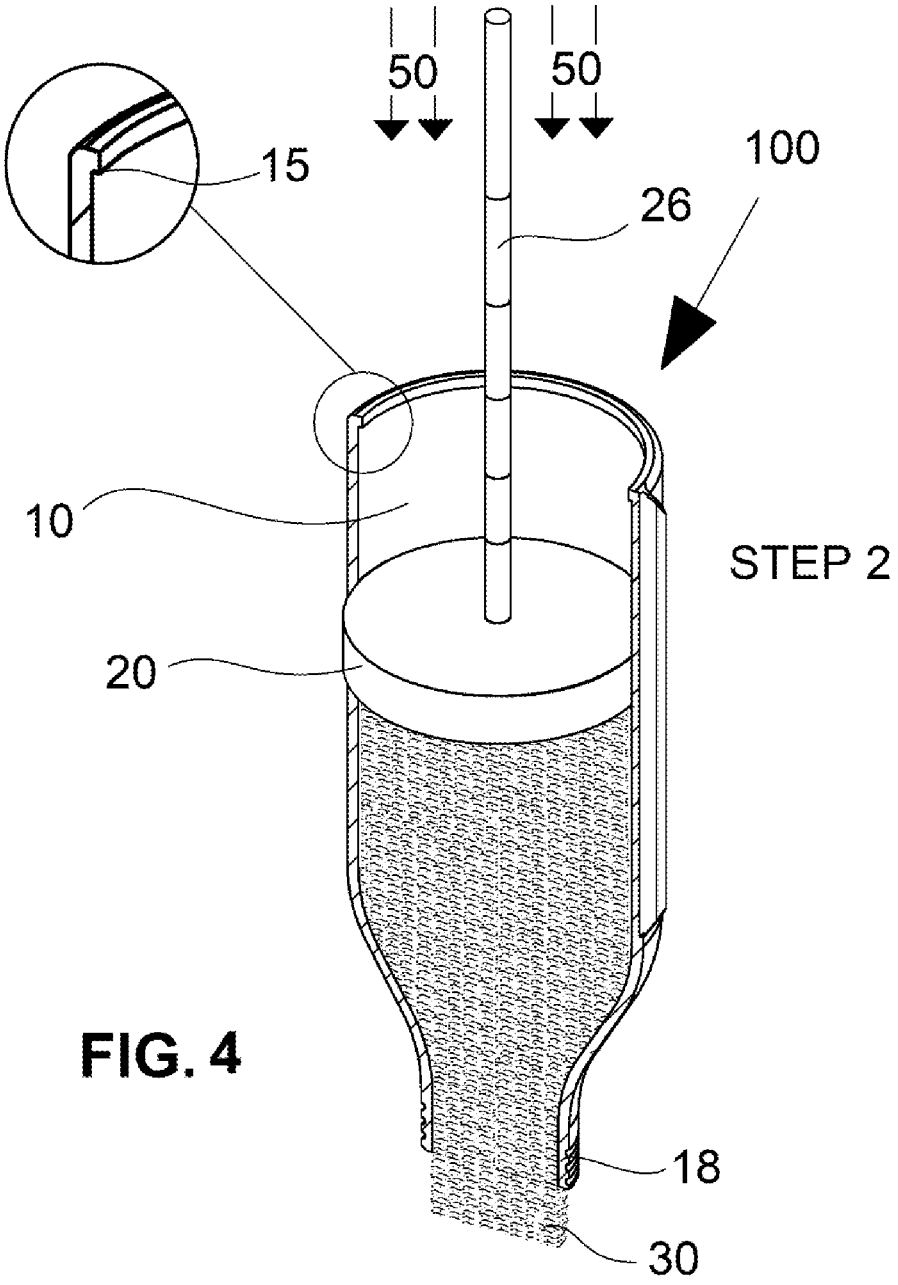
FIG. 4 is a sectioned-perspective view of a portable paste dispenser illustrating the second step of using thereof, according to one embodiment of the invention.

FIG. 4 is a sectioned-perspective view of a portable paste dispenser illustrating the second step of using thereof, according to one embodiment of the invention.

A user pushes shaft 26 downwards (see arrows 50). As a result of pushing shaft 26 downwards, the shaft pushes the piston 20 (to which it connects to) downwards, which results with pouring some of the dispenser's content out of the container through its nozzle (18).

After finishing the dispensing, the user returns the shaft back to pedestal 12.

Reference numeral 15 denotes a stopper in a form of a ring, which prevents from piston 20 to go out of container 10.

Figure 5:
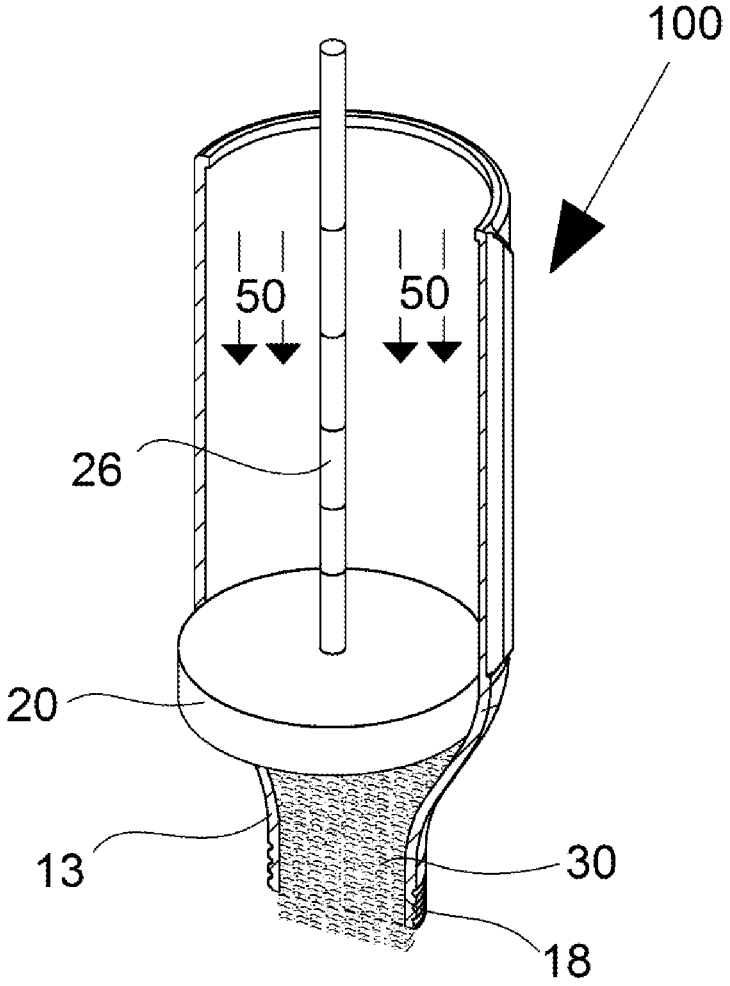
FIG. 5 is a sectioned-perspective view of a portable paste dispenser illustrating the third step of using thereof, according to one embodiment of the invention.

FIG. 5 is a sectioned-perspective view of a portable paste dispenser illustrating the third step of using thereof, according to one embodiment of the invention.

In this figure, the piston 20 has reached to a point in which the conical part of the container 10 prevents from piston 20 to continue to move downwards.

As illustrated, in this situation not all the content 30 of the dispenser has been dispensed. Some of the content 30 remains in the conical part 13 of the container.

Figure 6:
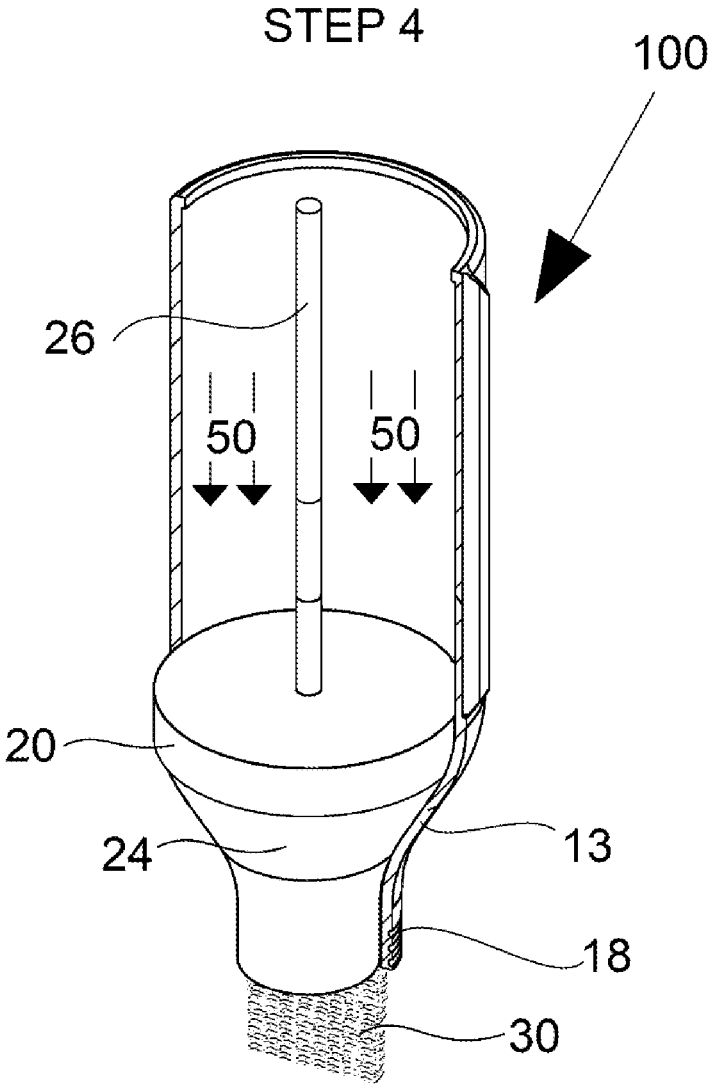
FIG. 6 is a sectioned-perspective view of a portable paste dispenser illustrating the fourth and last step of using thereof, according to one embodiment of the invention.

FIG. 6 is a sectioned-perspective view of a portable paste dispenser illustrating the fourth and last step of using thereof, according to one embodiment of the invention.

As the user continues to push the shaft 26 downwards (see arrows 50), the piston 20 expands to a conical form. The conical part of the piston is marked by reference numeral 24. The dimensions of the conical part 24 of the piston correspond to the dimensions of the inner side of the conical part 13 of the container. As a result the entire content of the container is dispensed. The conical part 24 may be, for example, in a bellows form, plastic, etc.

The Structure of the Piston

Figure 7:
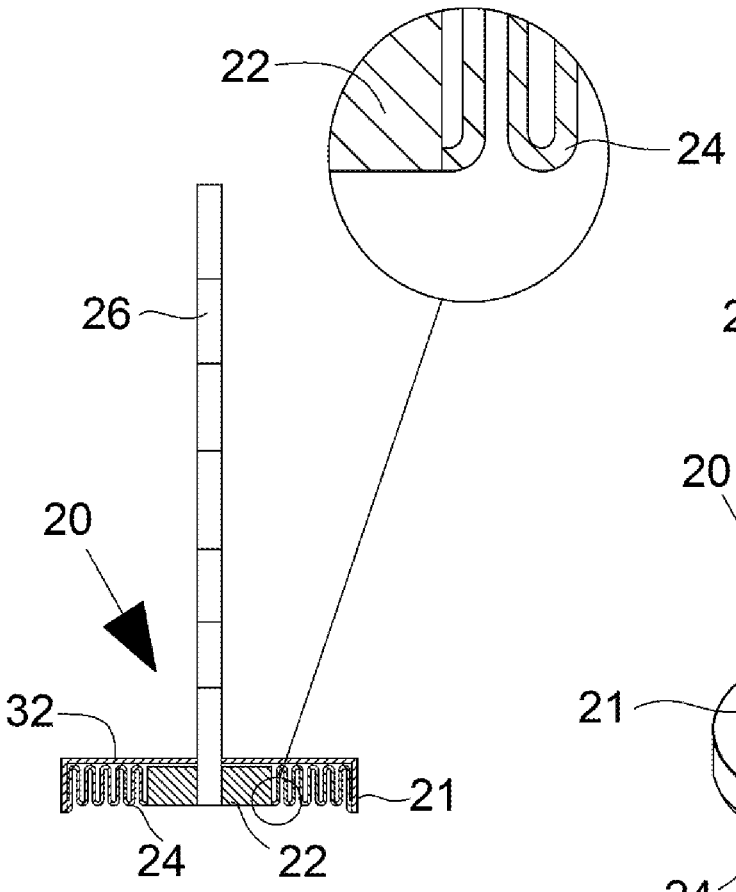
FIG. 7 is a sectioned view of a piston in a folded state, according to one embodiment of the invention.

FIG. 7 is a sectioned view of a piston in a folded state, according to one embodiment of the invention.

Figure 8:
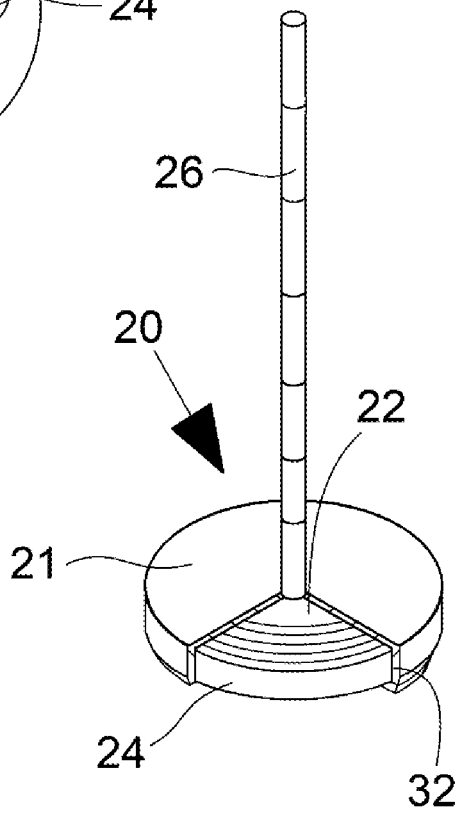
FIG. 8 is a perspective view thereof.

FIG. 8 is a perspective view thereof.

Figure 9:
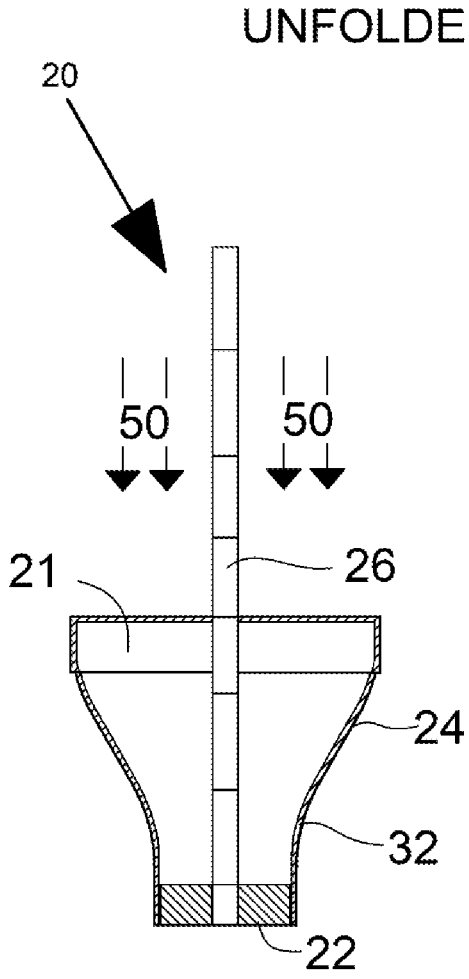
FIG. 9 is a sectioned view of a piston in an unfolded state, according to one embodiment of the invention.

FIG. 9 is a sectioned view of a piston in an unfolded state, according to one embodiment of the invention.

Figure 10:
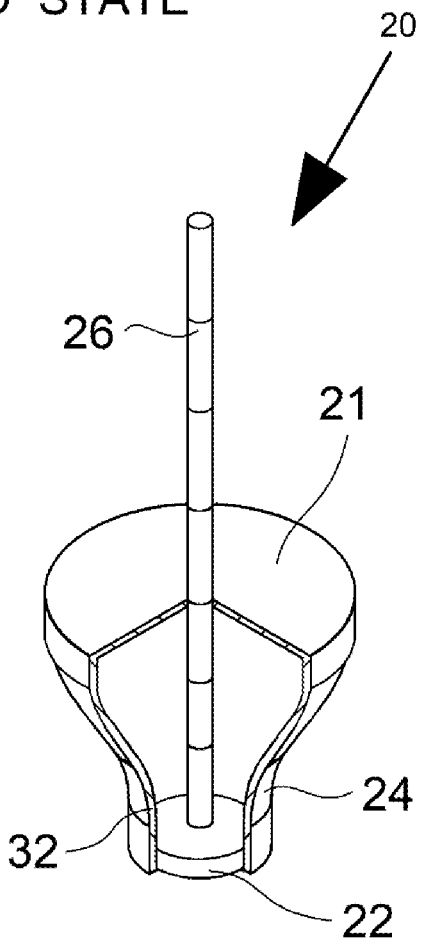
FIG. 10 is a perspective view thereof.

FIG. 10 is a perspective view thereof.

In these FIGS. 7 to 10), reference numeral 32 denotes a cross-sectioned area.

FIGS. 7 and 8 show the bellows form walls 24 of piston 20 in a folded state thereof, according to one embodiment of the invention. The bellows form walls 24 are connected to a washer (ring) 22, which is used as a base to which the shaft 26 is connected. Numeral 21 denotes a cover.

Upon pushing the shaft 26 downwards, the bellows form folded walls 24 straighten up, and as a result the piston gets a conical form. The conical form of the piston, i.e., in the unfolded state, is illustrated in FIGS. 9 and 10.

The structure of the shaft

Shaft 26 has a limited foldability so that when the shaft is pushed towards the piston, it still is able to move the piston.

Shafts of limited foldability are used, for example, as camping tent poles. They are made of mating stiff links.

Figure 11:
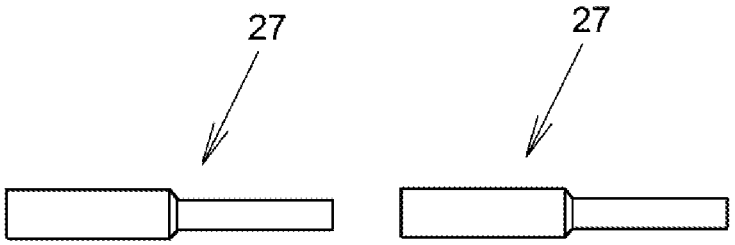
FIG. 11 illustrates some links (sections) of a shaft, according to one embodiment of the invention.

FIG. 11 illustrates links (sections) 27 of a shaft, according to one embodiment of the invention.

Figure 12:
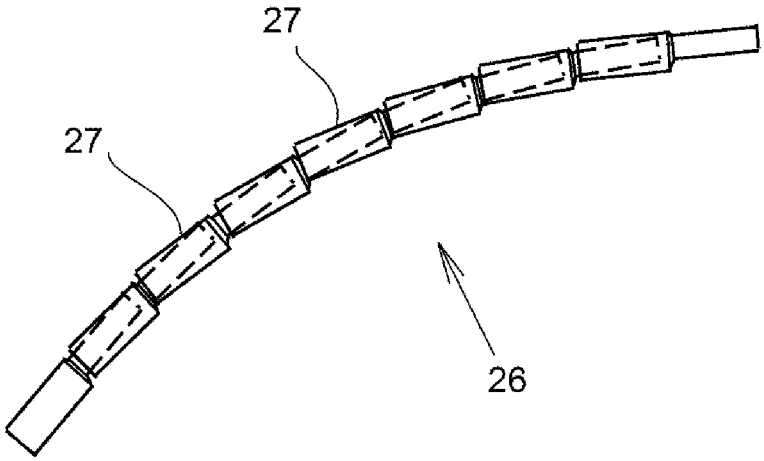
FIG. 12 illustrates a bent shaft, according to one embodiment of the invention.

FIG. 12 illustrates the way links 27 of a shaft mate in order to form an arc.

Of course, an elastic pole may also provide limited foldability. The solution illustrated in FIGS. 11 and 12 is only an example.

In the figures and/or description herein, the following reference numerals (Reference Signs List) have been mentioned:

- numeral 100 denotes a portable paste dispenser, according to one embodiment of the invention;
- numeral 10 denotes a container;
- numeral 11 denotes a cylindrical part of container 10;
- numeral 12 denotes a pedestal;
- numeral 13 denotes a conical part of container 10;
- numeral 14 denotes a lid of the container 10;
- numeral 15 denotes a stopper in a form of a ring, which prevents from the piston 20 to go out of the container 10;
- numeral 18 denotes a nozzle through which the paste is dispensed;
- numeral 20 denotes a piston;
- numeral 21 denotes a cover;
- numeral 22 is a washer (ring);
- numeral 24 denotes a foldable walls in a bellows form of piston 20;
- numeral 26 denotes a shaft having a limited foldability;
- numeral 27 denotes a link (section) of shaft 26;
- numeral 30 denotes paste;
- numeral 32 denotes a cross-sectioned area; and
- numeral 50 denotes arrows which demonstrate a direction in which a force is applied.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A portable paste dispenser (100), comprising:

a container (10), for storing therein paste (30), said container comprising a cylindrical part (11) and a conical part (13);

a nozzle (18) at the end of said conical part (13);

a piston (20), disposed inside said cylindrical part (11) of said container; and a shaft (26) connected to said piston, said shaft having a limited foldability so that when said shaft is pushed towards said piston, it still is able to move said piston along said cylindrical part (11);

wherein said piston comprises foldable bellows walls, thereby upon applying force on said piston, said piston straightens up, resulting in a conical form correspondingly to said conical part (13), thereby allowing fully emptying said container.

2. The dispenser according claim 1, further comprising a pedestal (12) connected to said container from outside, for allowing detachably attaching said shaft (26) to said pedestal.

3. The dispenser according claim 1, wherein said shaft (26) comprises a plurality of mating links (27), each having a limited tilting ability with reference to its subsequent link.

4. The dispenser according to claim 1, wherein said container (10) is rigid.

5. The dispenser according to claim 1, wherein said container (10) is flexible, thereby allowing dispensing said paste also by squeezing said container (10).

6. The dispenser according claim 1, wherein said paste (30) is ketchup.

7. The dispenser according claim 1, wherein said paste (30) is mayonnaise.

8. The dispenser according claim 1, wherein said paste (30) is toothpaste.

9. The dispenser according claim 1, wherein said paste (30) is shoe polish.

* * * * *